US006480161B2

(12) United States Patent
Watson

(10) Patent No.: US 6,480,161 B2
(45) Date of Patent: Nov. 12, 2002

(54) MOTORIZED ANTENNA POINTING DEVICE

(75) Inventor: P. Thomas Watson, Alpharetta, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 42 days.

(21) Appl. No.: 09/751,284

(22) Filed: Dec. 29, 2000

(65) Prior Publication Data

US 2002/0084948 A1 Jul. 4, 2002

(51) Int. Cl.[7] ..... E04G 3/00
(52) U.S. Cl. ..... 343/766; 343/758
(58) Field of Search ..... 343/766, 757, 343/761, 882, 890, 765, 758, 763; 248/282, 522

(56) References Cited

U.S. PATENT DOCUMENTS

| | | | | |
|---|---|---|---|---|
| 110,434 | A | 12/1870 | Clarke | |
| 2,575,917 | A | 7/1949 | Johnson | 287/14 |
| 2,611,566 | A | 12/1950 | Landis | 248/44 |
| 2,667,317 | A | 1/1954 | Trebules | 248/43 |
| 4,126,865 | A | 11/1978 | Longhurst et al. | 343/766 |
| 4,237,465 | A | 11/1980 | Shibano et al. | 343/894 |
| 4,495,706 | A | 1/1985 | Kaminski | 33/333 |
| 4,626,864 | A | 12/1986 | Micklethwaite | 343/766 |
| 4,691,207 | A * | 9/1987 | Timineri | 343/766 |
| 4,726,259 | A | 2/1988 | Idler | 74/785 |
| 4,833,932 | A | 5/1989 | Rogers | 74/5.1 |
| 5,065,969 | A * | 11/1991 | McLean | 248/282 |
| 5,276,972 | A | 1/1994 | Staney | 33/271 |
| 5,351,060 | A | 9/1994 | Bayne | 343/766 |
| 5,469,182 | A | 11/1995 | Chaffee | 343/882 |
| 5,473,335 | A | 12/1995 | Tines | 343/766 |
| 5,561,433 | A | 10/1996 | Chaney et al. | 342/359 |
| 5,646,638 | A | 7/1997 | Winegard et al. | 343/882 |
| 5,647,134 | A | 7/1997 | Chou | 33/355 |
| 5,657,031 | A | 8/1997 | Anderson et al. | 343/757 |
| 5,734,356 | A | 3/1998 | Chang | 343/882 |
| 5,760,739 | A | 6/1998 | Pauli | 342/359 |
| 5,829,121 | A | 11/1998 | Shoemaker et al. | 29/600 |
| 5,870,059 | A | 2/1999 | Reynolds | 343/760 |
| 5,894,674 | A | 4/1999 | Feldman | 33/354 |
| 5,903,237 | A | 5/1999 | Crosby et al. | 342/359 |
| 5,920,291 | A | 7/1999 | Bosley | 343/892 |
| 5,945,945 | A | 8/1999 | Wagner et al. | 342/359 |
| 5,977,922 | A | 11/1999 | Hemmingsen, II | 343/760 |
| 5,992,809 | A | 11/1999 | Sweere et al. | 248/278.1 |
| 5,999,139 | A | 12/1999 | Benjamin et al. | 343/765 |
| 6,023,247 | A | 2/2000 | Rodeffer | 343/765 |
| 6,031,508 | A | 2/2000 | Ishizuka et al. | 343/882 |
| 6,037,913 | A | 3/2000 | Johnson | 343/882 |
| 6,208,314 | B1 | 3/2001 | Bourquin | 343/872 |
| 6,229,480 | B1 | 5/2001 | Shintani | 342/359 |
| 6,262,687 | B1 | 7/2001 | Bai et al. | 343/757 |
| 6,285,338 | B1 | 9/2001 | Bai et al. | 343/882 |
| 6,331,839 | B1 | 12/2001 | Grenell | 343/840 |

* cited by examiner

*Primary Examiner*—Don Wong
*Assistant Examiner*—James Clinger
(74) *Attorney, Agent, or Firm*—Kirkpatrick & Lockhart LLP

(57) ABSTRACT

A portable alignment device for orienting an antenna in a desired azimuth orientation and methods for orienting an antenna in a desired azimuth orientation. In one embodiment, the device comprises a portable motor unit that is removably affixed to a portion of the antenna such as a portion of the antenna mounting bracket. A gear assembly is clamped to a portion of a mast to which the antenna mounting bracket is attached. The gear assembly is in meshing engagement with a driver gear attached to the motor's output shaft. By powering the motor, the antenna is pivoted about the mast until it is moved to a desired azimuth orientation. After the antenna has been oriented to a desired orientation and locked in that orientation, the portable motor unit is removed from the antenna and the gear assembly is removed from the mast to permit those devices to be used to orient other antennas.

34 Claims, 4 Drawing Sheets

MOTORIZED ANTENNA POINTING DEVICE

CROSS-REFERENCE TO RELATED APPLICATIONS

Not applicable.

FEDERALLY SPONSORED RESEARCH

Not applicable.

BACKGROUND OF THE INVENTION

1. Field of the Invention

The subject invention relates to alignment devices and, more particularly, to devices for aligning an antenna with a satellite.

2. Description of the Invention Background

The advent of the television can be traced as far back to the end of the nineteenth century and beginning of the twentieth century. However, it wasn't until 1923 and 1924, when Vladimir Kosma Zworkykin invented the iconoscope, a device that permitted pictures to be electronically broken down into hundreds of thousands of components for transmission, and the kinescope, a television signal receiver, did the concept of television become a reality. Zworkykin continued to improve those early inventions and television was reportedly first showcased to the world at the 1939 World's Fair in New York, where regular broadcasting began.

Over the years, many improvements to televisions and devices and methods for transmitting and receiving television signals have been made. In the early days of television, signals were transmitted and received through the use of antennas. Signal strength and quality, however, were often dependent upon the geography of the land between the transmitting antenna and the receiving antenna. Although such transmission methods are still in use today, the use of satellites to transmit television signals is becoming more prevalent. Because satellite transmitted signals are not hampered by hills, trees, mountains. etc., such signals typically offer the viewer more viewing options and improved picture quality. Thus, many companies have found offering satellite television services to be very profitable and, therefore, it is anticipated that more and more satellites will be placed in orbit in the years to come. As additional satellites are added, more precise antenna/satellite alignment methods and apparatuses will be required.

Modem digital satellite communication systems typically employ a ground-based transmitter that beams an uplink signal to a satellite positioned in geosynchronous orbit. The satellite relays the signal back to ground-based receivers. Such systems permit the household or business subscribing to the system to receive audio, data and video signals directly from the satellite by means of a relatively small directional receiver antenna. Such antennas are commonly affixed to the roof or wall of the subscriber's residence or mast located in the subscriber's yard. A typical antenna constructed to received satellite signals comprises a dish-shaped receiver that has a support arm protruding outward from the front surface of the dish.

The support arm supports a low noise block amplifier with an integrated feed "LNBF". The dish collects and focuses the satellite signal onto the LNBF which is connected, via cable, to the subscriber's set top box.

To obtain an optimum signal, the antenna must be installed such that the centerline axis of the dish, also known as the "bore site" or "pointing axis", is accurately aligned with the satellite. To align an antenna with a particular satellite, the installer must be provided with accurate positioning information for that particular satellite. For example, the installer must know the proper azimuth and elevation settings for the antenna. The azimuth setting is the compass direction that the antenna should be pointed relative to magnetic north. The elevation setting is the angle between the Earth and the satellite above the horizon. Many companies provide installers with alignment information that is specific to the geographical area in which the antenna is to be installed.

The ability to quickly and accurately align the centerline axis of antenna with a satellite is somewhat dependent upon the type of mounting arrangement employed to support the antenna and the skill of the installer. Prior antenna mounting arrangements typically comprise a mounting bracket that is directly affixed to the rear surface of the dish. The mounting bracket is then attached to a vertically oriented mast that is buried in the earth, mounted to a tree, or mounted to a portion of the subscriber's residence or place of business. The mast is installed such that it is plumb (i.e., relatively perpendicular to the horizon). Thereafter, the installer must orient the antenna to the proper azimuth and elevation. These adjustments are typically made at the mounting bracket.

In an effort to automate the adjustment and positioning of an antenna, several different permanent motorized antenna mounts have been designed. For example, U.S. Pat. No. 4,726,259 to Idler, U.S. Pat. No. 4,626,864 to Micklethwaite, and U.S. Pat. No. 5,469,182 to Chaffe disclose different motorized antenna positioners that are designed to be permanently affixed to an antenna. Those devices are not designed such that they can be used to orient an antenna and then removed therefrom in order that they can be used to orient another antenna.

Thus, there is a need for a portable antenna alignment device that can be attached to antenna to automatically position the antenna in a desired orientation and removed therefrom to enable the device to be used to position other antennas.

SUMMARY OF THE INVENTION

In accordance with one form of the present invention, there is provided a device for orienting an antenna that has a mounting bracket assembly that is attached to a mast. This embodiment of the device includes a motorized driver gear that is attachable to the antenna and a gear assembly that is attachable to the mast. When the motorized driver gear is attached to the antenna and the driven gear is attached to the mast, the driven gear is in meshing engagement with the driver gear.

Another embodiment of the present invention comprises a portable antenna alignment device for orienting an antenna that has a mounting bracket that is attached to a mast. This embodiment of the alignment device includes a motor and a clamping assembly that is attached to the motor for removably clamping the motor to a portion of the antenna. The device further includes a driver gear attached to the motor, a first gear assembly that has a first gear segment, and a second gear assembly that has a second gear segment. The second gear assembly is attachable to the first gear assembly to clamp a portion of the antenna mast therebetween such that the first and second gear segments form a driven gear about the mast for meshing engagement with the driver gear.

Another embodiment of the present invention comprises a method of orienting an antenna in a desired azimuth orientation that includes supporting a mast in a vertical orientation such that the mast is plumb and affixing a mounting bracket that is attached to the antenna to the mast. The mounting bracket has azimuth locking members that permit the antenna to be pivoted to a desired azimuth position when loosened and thereafter serve to retain the antenna in the desired azimuth position when the locking members are locked in position. The method further includes affixing a motor that has a driver gear to the antenna and affixing a driven gear to the mast such that the driven gear is in meshing engagement with the driven gear. Thereafter, the azimuth locking members are loosened to permit the antenna to be pivoted to a desired azimuth orientation. The motor is then powered to rotate the antenna to the desired azimuth position.

Yet another embodiment of the present invention comprises a method of orienting an antenna in a desired azimuth orientation that includes mounting a mast in a vertical orientation and affixing a mounting bracket that is attached to the antenna to the mast. The mounting bracket has azimuth locking members that permit the antenna to be pivoted to a desired azimuth position when loosened and thereafter serve to retain the antenna in the desired azimuth position when the locking members are locked in position. The method also includes clamping a motor having a driver gear to a portion of the mounting bracket and clamping a driven gear to the mast in meshing engagement with the driver gear. The azimuth locking members are loosened to permit the portion of the mounting bracket to which the motor is clamped to pivot about the mounting mast. The motor is then powered to pivot the portion of the mounting bracket to which the motor is clamped to a desired azimuth orientation. Thereafter, the azimuth locking members are locked to retain the antenna in the desired azimuth orientation. The motor is detached from the antenna and the driven gear is detached from the mast.

It is a feature of the present invention to provide devices and methods that can be used to orient an antenna in a desired azimuth orientation.

It is another feature of the present invention to provide a device that has the above-mentioned attributes that is readily portable and that may be used to orient several antennas.

Yet another feature of the present invention is to provide methods of installing an orienting an antenna in a desired azimuth orientation that can be easily employed by a single installer.

Accordingly, the present invention provides solutions to the shortcomings of prior apparatuses and methods for orienting antennas for receiving satellite signals. Those of ordinary skill in the art will readily appreciate, however, that these and other details, features and advantages will become further apparent as the following detailed description of the embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
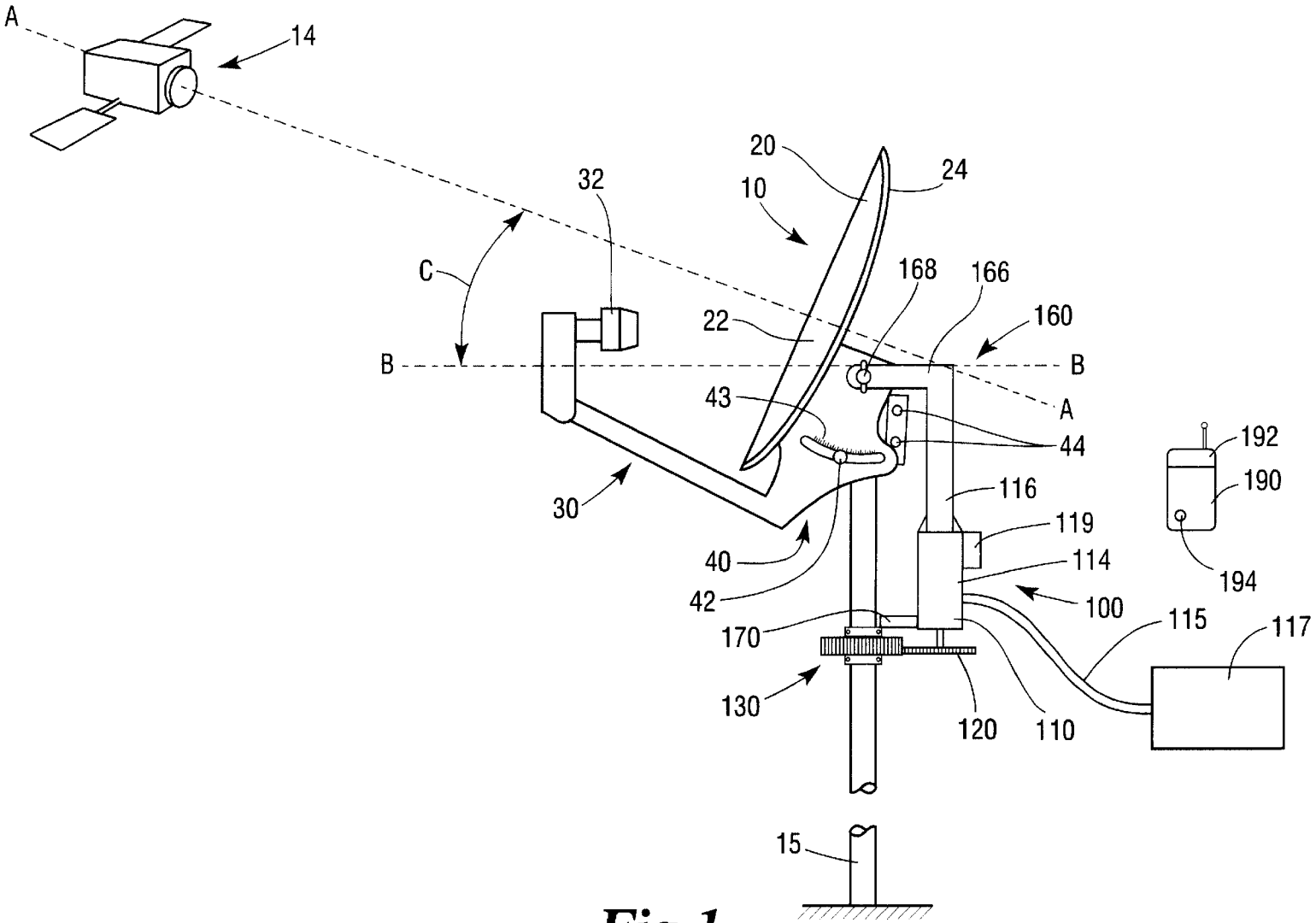
FIG. 1 is a side elevational view of one embodiment of the antenna alignment device of the present invention attached to a conventional antenna that is mounted to a mast to receive a signal from a satellite.

Referring now to the drawings for the purposes of illustrating embodiments of the invention only and not for the purposes of limiting the same, FIG. 1 illustrates a conventional antenna 10 that is supported by a vertically extending antenna mast 15. The mast 15 is mounted in the earth or attached to a structure (building, tree, etc.) such that it is plumb. Those of ordinary skill in the art will appreciate that various conventional methods exist for ensuring that the mast 15 is "plumb". For example, a convention level or plumb bob could be used.

The antenna 10 includes parabolic dish 20 and an arm assembly 30 that supports a LNBF 32 for collecting focused signals from the dish 20. Such LNBFs are known in the art and, therefore, the manufacture and operation of LNBF 32 will not be discussed herein. The dish 20 has a front surface 22 and a rear surface 24. A conventional mounting bracket assembly 40 is attached to the rear surface 24 of the dish and serves to adjustably support the antenna on the mast 15.

Antenna 10 must be properly positioned to receive the television signals transmitted by a satellite 14 to provide optimal image and audible responses. See FIGS. 1 and 2. This positioning process involves accurately aligning the antenna's centerline axis A—A, with the satellite's output signal. "Elevation", "azimuth" and "skew" adjustments are commonly required to accomplish this task. As shown in FIG. 1, elevation refers to the angle between the centerline axis A—A of the antenna relative to the horizon (represented by line B—B), generally designated as angle "C". In the antenna embodiment depicted in FIG. 1, the antenna's elevation is adjusted by loosening the an elevation adjustment bolt 42 and pivoting the antenna dish 20 to the desired elevation about a pivot axis D—D defined by the mounting bracket 40. See FIG. 3. Thereafter, the elevation adjustment bolt 42 is tightened to retain the antenna dish 20 in that orientation. To assist the installer in determining the proper elevation setting, a plurality of reference marks 43 are commonly provided on the mounting bracket. See FIG. 1.

Figure 2:
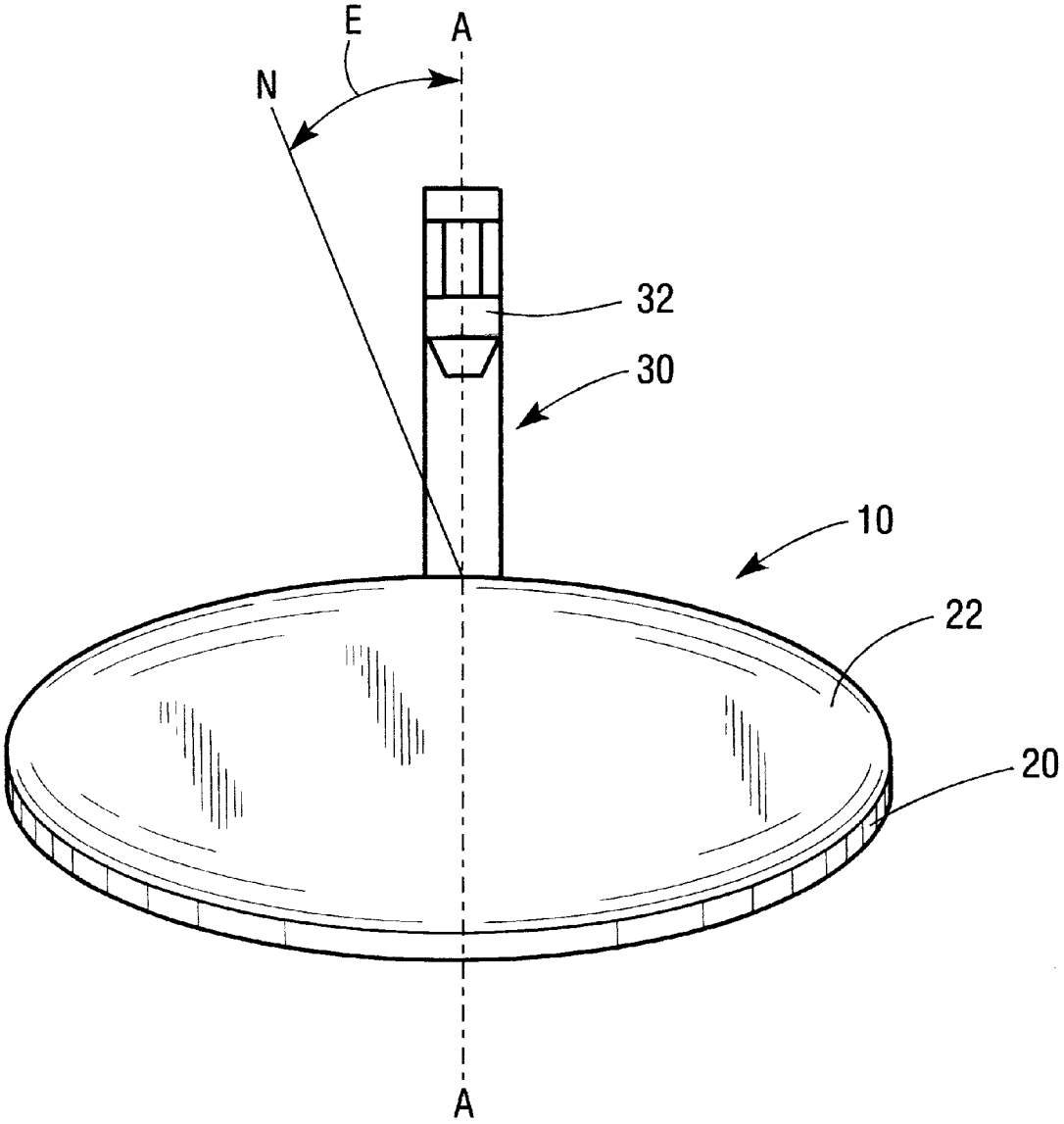
FIG. 2 is a top view of the antenna of FIG. 1.

As shown in FIG. 2, "azimuth" refers to the angle of axis A—A relative to the direction of magnetic north in a horizontal plane. That angle is generally designated as angle "E" in FIG. 2. To adjust the azimuth of the antenna 10, the mounting bracket assembly 40 is equipped with an azimuth locking members in the form of azimuth adjustment bolts 44. Azimuth adjustment bolts 44 are loosened and the antenna dish 20 is pivoted about the mast 15 until the desired azimuth orientation has been achieved. The azimuth adjustment bolts 44 are then retightened. A variety of different methods of determining the azimuth of the antenna have been developed. For example, the installer may support a conventional compass above or below the support arm and then align the support arm along the proper heading. An apparatus that employs a compass and an inclinometer for aligning a dish is disclosed in U.S. Pat. No. 5,977,992 and may be used to accomplish that task.

Figure 5:
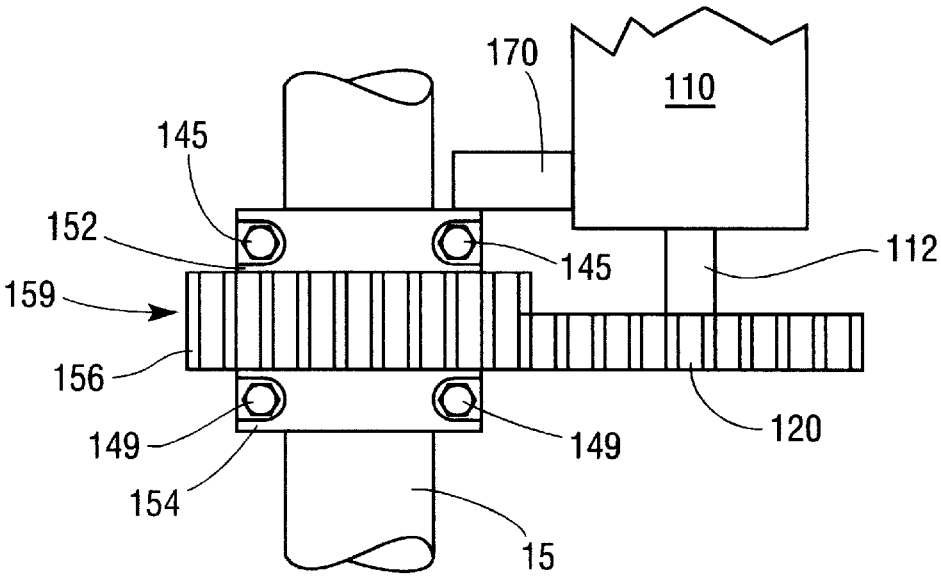
FIG. 5 is a partial view of antenna alignment device of the present invention coupled to antenna mast.
Figure 6:
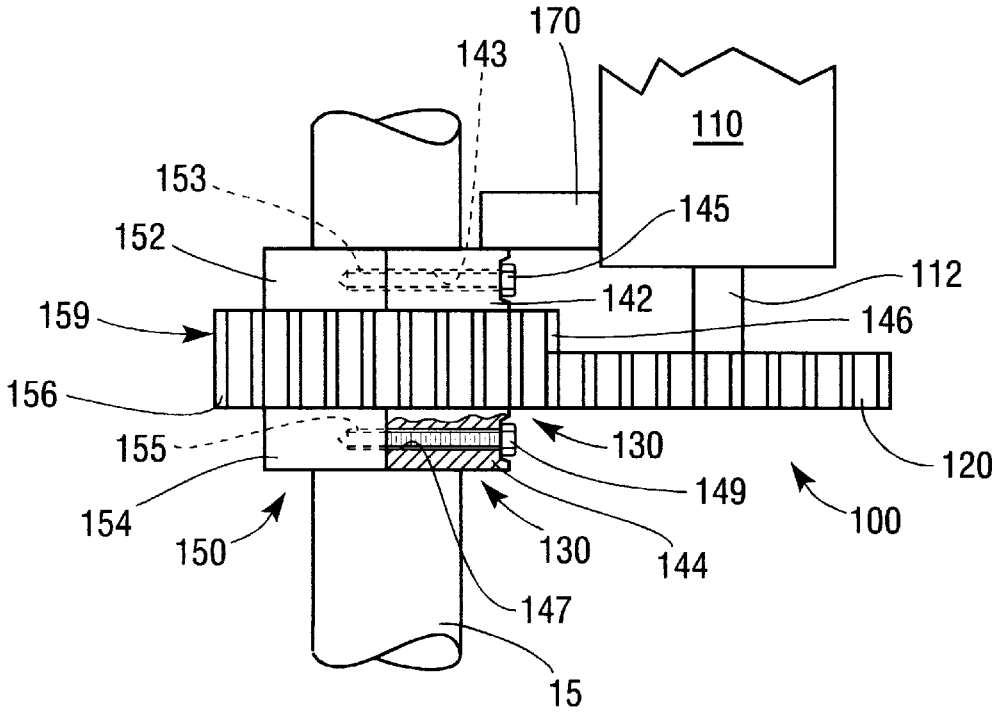
FIG. 6 is another partial view of the antenna alignment device of FIG. 5.

The motorized antenna alignment device 100 of the present invention may be employed to align the antenna 10 in a desired azimuth orientation. More specifically and with reference to FIGS. 1 and 3–6, one embodiment of the motorized antenna alignment device 100 includes a conventional motor 110. Motor 110 has a driven shaft 112 to which a driver gear 120 is non-rotatably affixed. Driver gear 120 is adapted to intermesh with the gear assembly 130 attached to the mast 15. Gear assembly 130 comprises a split collar assembly that is adapted to be removably affixed to the mast 15. As can be seen in FIGS. 1, 5 and 6, the gear assembly 130 includes a first gear assembly 140 and a second gear assembly 150. The first gear assembly 140 includes first and second collar portions (142, 144) and a first gear segment 146. Similarly, the second gear assembly 150 includes a primary collar portion 152, a secondary collar portion 154 and a second gear segment 156. The first collar portion 142 has a pair of holes hole 143 therethrough that are adapted to be coaxially aligned with a pair of threaded bores 153 in the primary collar portion 152. First clamping bolts 145 are inserted through holes 143 to be threadedly received in threaded bores 153. Likewise, the second collar portion 144 has a pair of holes 147 therethrough that are adapted to be coaxially aligned with a pair of threaded bores 155 in the secondary collar portion 154. Second clamping bolts 149 are inserted through holes 147 to be threadedly received in threaded holes in the secondary collar portion 154. Sec FIGS. 5 and 6. When clamped to the mast 15 as shown in FIGS. 5 and 6, the first gear segment 146 and the second gear segment 156 form a driven gear 159.

Figure 3:
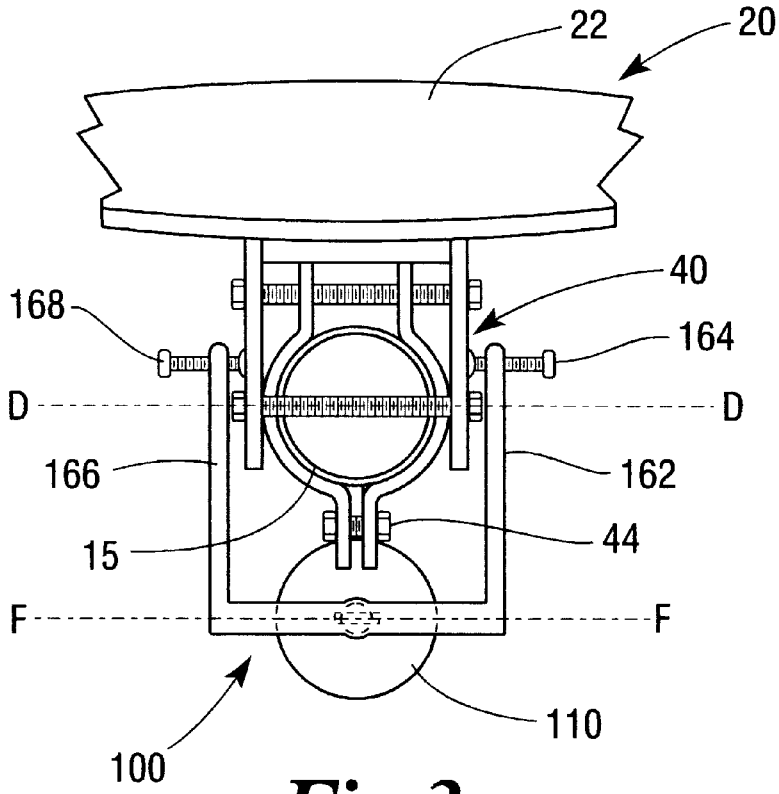
FIG. 3 is a top of view of the antenna alignment device and antenna depicted in FIG. 1.
Figure 4:
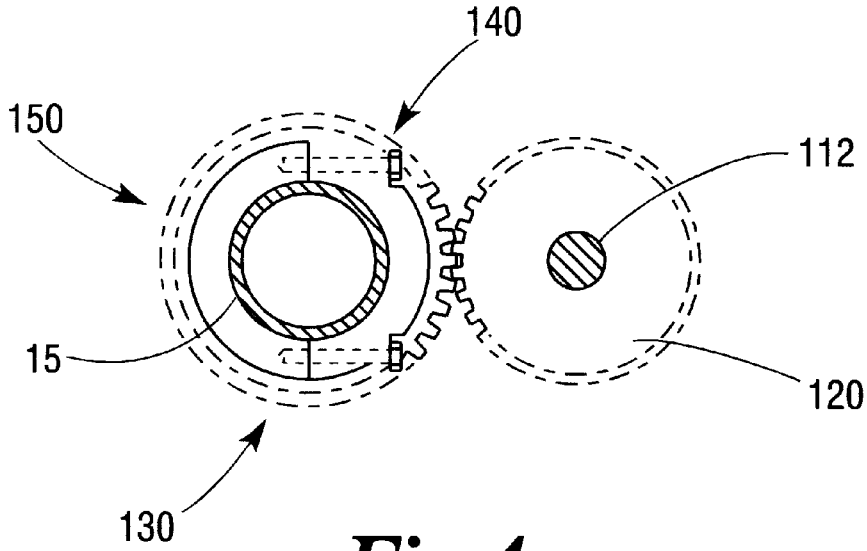
FIG. 4 is a partial view of a driver gear and a gear assembly of the antenna alignment device of FIGS. 1 and 3.

The motorized antenna alignment device 100 of this embodiment further includes a clamping arm assembly 160 that serves to clamp onto the mounting bracket assembly 40. As can be seen in FIG. 1, the clamping assembly 160 is rigidly attached to the housing 114 of the motor 110 by a vertically extending support member 116 that is attached to the motor housing 114 by, for example, screws or other fasteners (not shown). The clamping assembly 160 may be pivotally pinned to the vertical support member for pivotal travel about an axis F—F. See FIG. 3. The clamping assembly 160 includes a first clamping arm 162 and a second clamping arm 166. A first thumbscrew 164 is threaded through the first clamping arm 162 as shown in FIG. 3. A second thumbscrew 168 is threaded into the second clamping arm 166. The clamping assembly 160 may be clamped onto the mounting bracket assembly 40 by threading the first and second clamping screws (164, 168) into engagement with the mounting bracket assembly 40. Also in this embodiment, to provide support to the motor 110 when the alignment assembly 100 is affixed to the mast 15 and mounting bracket assembly 40 as shown in FIG. 1, a lower support member 170 is attached to the lower end of the motor housing 112. The lower support member 170 is adapted to slide around the top surfaces of the first and primary collar portions (142, 152). Those of ordinary skill in the art will appreciate that the motor 110 could be attached to other portions of the antenna utilizing other types of fastener arrangements without departing from the spirit and scope of the present invention. For example, the motor 110 could conceivably be attached or clamped to a portion of the antenna dish 20 as opposed to being clamped to a portion of the mounting bracket assembly 40.

In this embodiment, the motor 110 may receive power from a source of alternating current 117 through cord 115. Motor 110 may be controlled by a remote control hand held unit 190 that sends control signals to motor controls 119. Hand held unit 190 may be equipped with a conventional GPS unit 192 to enable the user to determine the longitude and latitude of the installation location. In addition, the hand held unit 190 may be equipped with a compass 194 that may be used to determine the azimuth orientation of the antenna 10.

This embodiment of the antenna alignment device 100 of the present invention may be used in the following manner. The installer clamps the clamping assembly 160 onto the mounting bracket assembly 40 by turning the first and second clamping screws (164, 168) into clamping engagement with the mounting bracket assembly 40. Thereafter, the gear assembly 130 is clamped onto the mast 15 with the clamping screws (145, 149) to attach it to the mast 15 as shown in FIGS. 5 and 6. As can be seen in FIG. 6, the driven gear 159 of the gear assembly 130 is in meshing engagement with the driver gear 120 and the lower support member 170 is supported on the collar portion 142. After the alignment device 100 is affixed to the mast 15 and mounting bracket assembly 40 as shown in FIGS. 1 and 3, the azimuth locking bolts 44 on the mounting bracket assembly 40 are loosened. The motor 110 is then powered to rotate the driver gear 120 about the driven gear 159 of the gear assembly 130 and cause the entire antenna 10 to rotate about the mast 15. Once the installer determines that the antenna 10 has been moved to the desired azimuth orientation utilizing conventional alignment methods and techniques, the motor 110 is stopped and the azimuth locking bolts 44 are locked in position. Thereafter, the alignment device 100 is unclamped from the mounting bracket assembly 40 and the gear assembly 130 is removed from the mast 15 to enable those devices to be used to align other antennas.

The embodiments of the present invention have been described herein for use in connection with a conventional antenna of the type depicted in FIG. 1. The skilled artisan will readily appreciate, however, that these embodiments of the present invention could be successfully employed with a myriad of other types of antennas and antenna mounting bracket configurations without departing from the spirit and scope of the present invention. Thus, the scope of protection afford to these embodiments of the present invention should not be limited to use in connection with the specific type of antenna depicted in FIG. 1.

The embodiments of the present invention represent a vast improvement over prior motorized antenna alignment devices. Due to its portable nature, the present invention is well-suited for use by installers that typically install and orient several antennas. The various embodiments of the present invention may be quickly attached to an existing antenna installation to orient the antenna in a desired azimuth orientation and thereafter be removed from the antenna for use in connection with another antenna that differs from the first antenna. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A device for orienting an antenna having a selectively adjustable mounting bracket assembly attached to a mast, said device comprising:

a gear assembly attached to the mast and extending therearound; and a motorized driver gear in meshing engagement with said gear assembly and removably attached to the mounting bracket such that activation of said motorized driver gear rotates the mounting bracket about the mast to a desired position and wherein said motorized driver gear is detachable from the mounting bracket without moving the mounting bracket from said desired position.

2. The device of claim 1 wherein said motorized driver gear is operably attached to a motor that is removably clamped to the antenna mounting bracket.

3. The device of claim 2 wherein said motor is attached to the antenna mounting bracket by a clamping assembly that comprises:

a vertical support arm attached to the motor;

first and second clamping arms attached to the vertical support arm;

a first thumbscrew attached to said first clamping arm; and a second thumbscrew attached to said second clamping arm.

4. The device of claim 3 wherein said first and second clamping arms are pivotally attached to said vertical support arm.

5. The device of claim 1 wherein said gear assembly is removably clamped to the mast.

6. The device of claim 5 wherein said gear assembly comprises:

a first gear assembly having first and second collar portions and a first gear segment;

a second gear assembly having primary and secondary collar portions and a second gear segment, said primary and secondary collar portions connectable to said first and second collar portions to clamp a portion of the mast therebetween such that said first and second gear segments cooperate to form said driven gear.

7. The device of claim 1 wherein said motorized driver gear is operably attached to a motor that is removably clamped to the antenna mounting bracket and wherein said motor has a support member for supporting engagement with said gear assembly.

8. The device of claim 2 wherein said motor is powered with alternating current from a source of alternating current and is controlled with a handheld unit.

9. The device of claim 8 wherein said handheld unit further comprises a global positioning unit.

10. The device of claim 8 wherein said handheld unit further comprises a compass.

11. A portable antenna alignment device for orienting an antenna having a mounting bracket attached to a mast, said alignment device comprising:

a motor;

a clamping, assembly attached to said motor, said clamping assembly removably clamping said motor to a portion of the antenna;

a driver gear attached to said motor;

a first gear assembly having a first gear segment;

a second gear assembly having a second gear segment, said second gear assembly attachable to said first gear assembly to clamp a portion of the antenna mast therebetween such that said first and second gear segments form a driven gear about the mast for meshing engagement with said driver gear.

12. The device of claim 11 wherein said clamping assembly comprises:

a vertical support arm attached to the motor;

first and second clamping arms attached to the vertical support arm;

a first thumb screw threadedly attached to said first clamping arm; and a second thumb screw threadedly attached to said second claming arm.

13. The device of claim 12 wherein said first and second clamping arms are pivotally attached to said vertical support arm.

14. The device of claim 11 wherein said first gear assembly has first and second collar portions and a first gear segment and wherein said second gear assembly has primary and secondary collar portions and a second gear segment, said primary and secondary collar portions connectable to said first and second collar portions to clamp a portion of the mast therebetween such that said first and second gear segments cooperate to form said driven gear.

15. The device of claim 11 wherein said motor is powered with alternating current from a source of alternating current and is controlled with a handheld unit.

16. The device of claim 15 wherein said handheld unit further comprises a global positioning unit.

17. The device of claim 15 wherein said handheld unit further comprises a compass.

18. A method of orienting an antenna in a desired azimuth orientation, said method comprising:

supporting a mast in a vertical orientation such that the mast is plumb;

affixing a mounting bracket that is attached to the antenna to the mast, the mounting bracket having azimuth locking members that permit the antenna to be pivoted to a desired azimuth position when loosened and thereafter retain the antenna in the desired azimuth position when the locking members are locked in position;

affixing a motor having a driver gear to the antenna;

affixing a driven gear to the mast such that the driven gear is in meshing engagement with the driven gear;

loosening the azimuth locking members to permit the antenna to be pivoted to a desired azimuth orientation;

powering the motor to rotate the antenna to the desired azimuth position;

locking the azimuth locking members to retain the antenna in the desired azimuth orientation; and detaching the motor from the antenna.

19. The method of claim 18 further comprising detaching the driven gear from the mast.

20. The method of claim 18 wherein said affixing the motor to the antenna comprises clamping the motor to the antenna.

21. The method of claim 18 wherein said affixing the driven gear comprises clamping the driven gear to the mast.

22. A method of orienting an antenna in a desired azimuth orientation, said method comprising:

mounting a mast in a vertical orientation;

affixing a mounting bracket that is attached to the antenna to the mast, the mounting bracket having azimuth locking members that permit the antenna to be pivoted to a desired azimuth position when loosened and thereafter retain the antenna in the desired azimuth position when the locking members are locked in position;

clamping a motor having a driver gear to a portion of the mounting bracket;

clamping a driven gear to the mast in meshing engagement with the driver gear;

loosening the azimuth locking members to permit the portion of the mounting bracket to which the motor is clamped to pivot about the mounting mast;

powering the motor to pivot the portion of the mounting bracket to which the motor is clamped to a desired azimuth orientation;

locking the azimuth locking members to retain the antenna in the desired azimuth orientation;

detaching the motor from the antenna; and detaching the driven gear from the mast.

23. A device for orienting an antenna having a mounting bracket assembly attached to a mast, said device comprising:

a motorized driver gear removably attachable to the antenna adjacent the mast and operably attached to a motor that is removably clamped to the antenna mounting bracket; and a gear assembly removably clamped to the mast and extending therearound, said gear assembly having first and second collar portions and a first gear segment, said gear assembly further having a second gear assembly having primary and secondary collar portions and a second gear segment, said primary and secondary collar portions connectable to said first and second collar portions to clamp a portion of the mast therebetween such that said first and second gear segments cooperate to form a driven gear in meshing engagement with said motorized driven gear.

24. The device of claim 23 wherein said motor is attached to the antenna mounting bracket by a clamping assembly that comprises:

a vertical support arm attached to the motor;

first and second clamping arms attached to the vertical support arm;

a first thumbscrew attached to said first clamping arm; and a second thumbscrew attached to said second clamping arm.

25. The device of claim 24 wherein said first and second clamping arms are pivotally attached to said vertical support arm.

26. The device of claim 23 wherein said motor is powered with alternating current from a source of alternating current and is controlled with a handheld unit.

27. The device of claim 26 wherein said handheld unit further comprises a global positioning unit.

28. The device of claim 26 wherein said handheld unit further comprises a compass.

29. A device for orienting an antenna having a mounting bracket assembly attached to a mast, said device comprising:

a gear assembly attached to the mast and extending therearound, said gear assembly having a driven gear; and a motorized driver gear removably attachable to the antenna adjacent the mast and in meshing engagement with said motorized driven gear, said motorized driver gear is operably attached to a motor that is removably clamped to the antenna mounting bracket and wherein said motor has a support member for supporting engagement with said gear assembly.

30. The device of claim 29 wherein said motor is attached to the antenna mounting bracket by a clamping assembly that comprises:

a vertical support arm attached to the motor;

first and second clamping arms attached to the vertical support arm;

a first thumbscrew attached to said first clamping arm; and a second thumbscrew attached to said second clamping arm.

31. The device of claim 30 wherein said first and second clamping arms are pivotally attached to said vertical support arm.

32. The device of claim 29 wherein said motor is powered with alternating current from a source of alternating current and is controlled with a handheld unit.

33. The device of claim 32 wherein said handheld unit further comprises a global positioning unit.

34. The device of claim 32 wherein said handheld unit further comprises a compass.

* * * * *